US008807670B2

(12) United States Patent
Blum

(10) Patent No.: US 8,807,670 B2
(45) Date of Patent: Aug. 19, 2014

(54) PIECE OF FURNITURE WITH ACTUATING ARM ARRANGEMENT

(75) Inventor: Johannes Blum, Fussach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/399,205

(22) Filed: Feb. 17, 2012

(65) Prior Publication Data

US 2012/0161598 A1 Jun. 28, 2012

Related U.S. Application Data

(63) Continuation of application No. PCT/AT2010/000291, filed on Aug. 10, 2010.

(30) Foreign Application Priority Data

Aug. 20, 2009 (AT) ..... A 1306/2009

(51) Int. Cl.

| | |
|---|---|
| ***A47B 95/02*** | (2006.01) |
| ***A47B 88/00*** | (2006.01) |
| ***E05F 1/08*** | (2006.01) |
| ***E05F 5/00*** | (2006.01) |
| *E05F 5/08* | (2006.01) |
| *E05F 1/10* | (2006.01) |
| *E05F 1/12* | (2006.01) |

(52) U.S. Cl.

CPC ..... *E05F 1/1276* (2013.01); *E05F 5/08* (2013.01); *E05F 1/1058* (2013.01); *E05F 5/006* (2013.01); *E05Y 2900/20* (2013.01); *E05Y 2800/00* (2013.01); *E05Y 2201/244* (2013.01); *E05F 1/1075* (2013.01); *E05Y 2201/424* (2013.01); *E05Y 2201/22* (2013.01); *E05F 1/1261* (2013.01); *E05Y 2201/626* (2013.01)

USPC ..... 312/319.2; 312/328; 16/286

(58) Field of Classification Search

USPC ..... 312/327, 328, 319.2, 323; 16/286, 366, 16/369; 49/263, 272, 273, 274, 276, 277; 1/327, 328, 319.2, 323

See application file for complete search history.

(56) References Cited

U.S. PATENT DOCUMENTS 5,882,099 A * 3/1999 Salice ..... 312/328
6,367,123 B1 * 4/2002 Cheal et al. ..... 16/370

(Continued)

FOREIGN PATENT DOCUMENTS

AT 9076 4/2007
AT 507 279 3/2010

(Continued)

OTHER PUBLICATIONS

Machine Translation of EP 1840309 A1.*

(Continued)

*Primary Examiner* — Janet M Wilkens
*Assistant Examiner* — Andrew Roersma
(74) *Attorney, Agent, or Firm* — Wenderoth, Lind & Ponack, L.L.P.

(57) ABSTRACT

A piece of furniture has an actuating arrangement for a flap of the piece of furniture. An actuating arm arrangement includes a lever arrangement for moving the flap and a main spring that acts in the closing direction (SR) to hold the flap closed. The piece of furniture also has an ejecting device for ejecting the flap in the opening direction (OR) by overpressing the flap in the closing direction (SR). At least one support spring acts in the opening direction (OR) and is separate from the ejecting device, and supports the ejecting motion of the ejecting device. At least in an overpressed closed position (US), the spring forces (A, U) are together greater than the closing force (Z) which acts on the flap and which is provided by the main spring acting in the closing direction (SR).

4 Claims, 14 Drawing Sheets

(56) References Cited

U.S. PATENT DOCUMENTS

| | | | | |
|---|---|---|---|---|
| 6,442,799 | B1 * | 9/2002 | Duarte et al. | 16/277 |
| 6,877,830 | B2 * | 4/2005 | Salice | 312/327 |
| 7,197,790 | B1 * | 4/2007 | Edmondson | 16/336 |
| 7,448,703 | B2 * | 11/2008 | Kung | 312/327 |
| 7,976,079 | B2 * | 7/2011 | Hirtsiefer | 292/262 |
| 2005/0242593 | A1 * | 11/2005 | Migli | 292/220 |
| 2006/0174444 | A1 * | 8/2006 | Giovannetti | 16/354 |
| 2006/0284530 | A1 * | 12/2006 | Hollenstein | 312/327 |
| 2007/0124893 | A1 * | 6/2007 | Brustle | 16/296 |
| 2008/0048538 | A1 * | 2/2008 | Karg | 312/319.2 |
| 2008/0196203 | A1 * | 8/2008 | Giovannetti | 16/239 |

FOREIGN PATENT DOCUMENTS

| | | | | |
|---|---|---|---|---|
| CN | 201133180 | | 10/2008 | |
| DE | 20 2004 019 238 | | 2/2005 | |
| DE | 202006000535 | U1 * | 9/2006 | A47B 96/20 |
| DE | 202007006690 | U1 * | 9/2008 | E05D 3/16 |
| EP | 1 840 309 | | 10/2007 | |
| WO | 03/097973 | | 11/2003 | |
| WO | WO 2006111236 | A1 * | 10/2006 | E05D 3/06 |
| WO | 2008/077520 | | 7/2008 | |
| WO | WO 2008119647 | A1 * | 9/2008 | E05F 3/20 |
| WO | 2010/022414 | | 3/2010 | |

OTHER PUBLICATIONS

International Search Report issued Nov. 23, 2010 in International (PCT) Application No. PCT/AT2010/000291.

Austrian Patent Office Search Report issued May 18, 2010 in Austrian Patent Application No. A 1306/2009.

Chinese Search Report issued in parallel Chinese Patent Application No. 201080036703.X.

* cited by examiner

PIECE OF FURNITURE WITH ACTUATING ARM ARRANGEMENT

This application is a Continuation of International No. PCT/AT2010/000291, filed Aug. 10, 2010, the entire disclosure of which is incorporated herein by reference.

BACKGROUND OF THE INVENTION

The invention relates to a piece of furniture with an adjusting arm arrangement for a furniture flap. The adjusting arm arrangement comprises a lever arrangement to move the flap, a main spring acting in a closing direction to lock the flap, and an ejection device attached to the piece of furniture or adjusting arm arrangement to eject the flap in an opening direction by overpressing the flap in closing direction. Furthermore, the invention relates to an adjusting arm arrangement for a furniture flap with a lever arrangement to move the flap, a main spring acting in the closing direction on the flap via the lever arrangement and a pusher which is loaded via a support spring acting in the opening direction and which lies or can be laid against a lever of the lever arrangement, as well as a set of two different types of adjusting arm arrangements for moving a furniture flap.

Such pieces of furniture with adjusting arm arrangements (upward-folding brackets) have already been state of the art for some time. Above all they serve to simplify the upward-folding movement or the raising movement for a user. To support opening movements of a flap or of a part of a piece of furniture, so-called TIP-ON mechanisms have already been used for many years. For example, these can function according to the ballpoint pen principle, wherein the ejecting part is pushed into the closed position when closing the flap. In this position, the ejector is locked (for example in a cardioid), whereby the spring-loaded ejector is unlocked by overpressing behind the closed position, i.e. by pressing in closing direction. The spring force can thereby display its effect and move the ejector of the ejection device in opening direction, as a result of which the flap lying against same or the part of the piece of furniture is opened.

This principle is very helpful above all with heavy drawers or furniture doors without handles, as already after a relatively short automatic opening path, the complete opening can take place manually without additional support mechanisms by the user.

Unlike drawers or doors which can be pulled out, this relatively small opening path of a few centimeters is not sufficient in the case of a furniture flap to finish the opening movement by hand. As such, upward-folding pieces of furniture are often difficult to access and not easily reachable. Therefore, the upward-folding movement is supported starting from a specific angle of opening by the main spring and the lever arrangement or a neutral movement is made possible.

With relatively small and light flaps, the locking force of the main spring can already be overcome by the ejection device alone. If, however, large and heavy flaps or a strong main spring is used, the ejection device—which as standard mainly acts with a force of approximately 10-17 Newton on the lower area of the flap—cannot overcome the locking force of the main spring acting on the flap.

SUMMARY OF THE INVENTION

Therefore, the object of the invention is to create a piece of furniture or an adjusting arm arrangement, improved vis-à-vis the state of the art which, when using a standard ejection device, makes possible the opening of the flap even with heavy and large flaps.

This object is achieved by at least one support spring acting in the opening direction, separate from the ejection device, to support the ejection movement of the ejection device. At least in the overpressed closed position the spring forces, acting in the opening direction on the flap, preferably measured in the lower flap area, of the ejection device and of the support spring are together greater than the locking force acting on the flap, preferably measured in the lower flap area, of the main spring acting in closing direction. In other words, this means that the support spring compensates or reduces the locking force of the main spring. This then relatively low locking force can be overcome by the standard ejection device, whereby the support spring, together with the ejection device, applies sufficient force/torque to the flap to overcome the locking force of the main spring. The two opening forces together should, at least up to an opening angle of approx. 10-40°, preferably between 20 and 30°, be higher than the locking force acting in this area.

As the ejection device is arranged preferably in the lower area of the furniture body and acts there on the lower area of the flap (in order to achieve a better lever effect), all the force values given here relate to its effect in the lower area of the flap. In particular, the force values are always measured on the underside of the front flap. Thus, they say nothing about the pure force of the individual springs (main spring, ejection spring, support spring) as these are (can be) kinematically strengthened or changed via levers. Accordingly, a preferred embodiment provides that the forces acting on the flap are measured in the lower flap region, preferably on the front underside.

Generally, it is not to be excluded that at least one of the springs mentioned in this document is designed not as a spring but as any other type of force-generating or elastic element (hydraulic device, motor, elastic compensation element). Generally, thus, any desired force storage device can be provided which preferably is mechanically loaded during closing.

According to a preferred embodiment, the spring force acting in the opening direction of the ejection device can be, in the overpressed closed position, between 5 and 20 N, preferably between 10 and 17 N, particularly preferably between 12 and 15 N. For use in upward-folding cupboards/pieces of furniture, only relatively small ejection devices are advisable, as others would take up to much room or would project too far forward when ejected.

Particularly preferably it can be provided that the support spring is arranged in a housing and acts, via a pusher guided by the support spring, on a lever of the lever arrangement. Thus, the transmission onto a specific lever can be optimized.

A preferred embodiment of the invention can furthermore provide that the support spring, the housing and the pusher together form an ejection-support device which is attached to the lever arrangement and is movement-coupled to this. The ejection-support device forms a single easily removable or detachable component. The arrangement of the ejection-support device directly on the lever arrangement means, in other words, that it is housed "floating" on a lever of the lever arrangement. Thus it moves along with the lever arrangement and can act over a longer opening path than the ejection device against the locking force of the main spring. This is achieved, according to a preferred embodiment, by the ejection-support device being attached to a lever of the lever arrangement and acting on another lever of the lever arrangement.

Preferably, the support spring can be tensioned by a lever of the lever arrangement during closing, and the support spring also damps the closing movement of the flap.

Generally, it is not to be excluded that the support spring acting on a lever of the lever arrangement can be unlocked by overpressing. Due to the ejection device and the support spring being separate, the two springs, acting in opening direction, act at different points in the piece of furniture or on the adjusting arm arrangement.

According to a further preferred embodiment, the spring force acting in the opening direction of the support spring can compensate for the locking force acting in the closing direction of the main spring to a value which is less than the ejection force acting in the opening direction of the ejection device. Thus, the support feature housed floating in the opening direction is designed such that the ejection device helps the flap to open after unlocking.

Furthermore, the invention relates to an adjusting arm arrangement for a furniture flap with a lever arrangement for moving the flap, a main spring acting on the flap in the closing direction via the lever arrangement, and a pusher which is loaded via a support spring acting in opening direction and which lies or can be laid against a lever of the lever arrangement.

Generally, adjusting arm arrangements for raising a furniture flap in which a lever arrangement for moving the flap, a main spring acting in closing direction for locking the flap, and a damping device which damps the closing movement of the flap are already known from the state of the art. A smooth and easy-running closing of the flap above all in the last closing section is thereby achieved without noisy banging. In such damping devices, a relatively small spring, acting in the opening direction, is already arranged but serves only to push the pusher back out again after the opening movement of the flap. The pusher is prevented from carrying out a rapid closing movement generally by the damping medium during the closing movement. In contrast to this, during the opening movement, this pusher has no effect on a lever or on the flap. The pusher is merely moved in opening direction by the auxiliary spring without being able to support or influence the opening movement of the flap at all. This pusher is thus influenced more by the force of the damping medium than by the auxiliary spring. This manifests itself above all in that, when opening the flap, the pusher cannot keep up with the movement of the lever at all, as an uninfluenced ejection of the lever is prevented by the damping medium.

Thus, the object of the invention lies in providing a support spring, improved vis-à-vis the state of the art, for the opening movement of an adjusting arm. In particular, the support spring is to load the pusher such that the pusher always lies against the lever up to its maximum open position.

This is achieved in that the only spring force of the support spring for supporting an ejection device attached to a piece of furniture or to the adjusting arm arrangement acts on the pusher. Thus, the support spring can act directly on the lever of the lever arrangement without any influence from a damping medium and can support the opening movement.

According to a preferred embodiment, the pusher, the support spring, and a housing together form an ejection-support device which is attached to a lever of the lever arrangement and acts via the pusher on another lever of the lever arrangement. Preferably, the pure force of the support spring does not overcome the locking force of the main spring. For this, the attachment of an additional TIP-ON device/ejection device to the adjusting arm arrangement or to the piece of furniture is necessary. Generally, it is not to be excluded that several support springs are arranged in one and the same area or in different areas of the adjusting arm arrangement.

Furthermore, the invention relates to a set consisting of a first and a second type of adjusting arm arrangements for a furniture flap. Each adjusting arm arrangement comprises a lever arrangement for moving the flap and a main spring acting in closing direction to lock the flap, and the first type additionally has a damping device which damps the closing movement of the flap.

The object of this additional invention is to make possible/create a simpler storage and a better and simpler production method for the two types of adjusting arm arrangements.

This is achieved in that, instead of the damping device of the first type, the second type has an ejection-support device which comprises at least one support spring acting in opening direction, loading a pusher, for supporting an ejection device attached to the piece of furniture or to one of the adjusting arm arrangements. The pusher lies or can be laid against a lever of the lever arrangement and only spring force of the support springs acts on the pusher. It is thus to be prevented that a manufacturer produces two product lines in which most parts are identical and only, instead of the damping device, an ejection-support device is arranged at substantially the same point.

For this, in a preferred embodiment the pusher and the support spring are arranged or guided in a housing of the ejection-support device. A particular advantage with this design is that both types of adjusting arm arrangements are largely identical. During production, only instead of the damping device, the support spring must be attached to the otherwise identical lever of the lever arrangement and at least one ejection device should be provided at an adjusting arm arrangement itself or at the piece of furniture. In this respect, it can preferably be provided that the damping device of the first type and the support spring of the second type have substantially the same overall dimensions. Thus, all kinematic properties of the remaining lever arrangement or adjusting arm arrangement in both types can remain substantially unchanged and both a comfortable closing and opening of the flap are guaranteed. Thus, the entire production and storage of the two adjusting arm arrangement types becomes substantially more efficient.

Protection is also sought for a piece of furniture with an adjusting arm arrangement as described above.

BRIEF DESCRIPTION OF THE DRAWINGS

Further details and advantages of the present invention are explained in more detail below with reference to the embodiments represented in the drawings, in which.

DETAILED DESCRIPTION OF THE INVENTION

Figure 1:
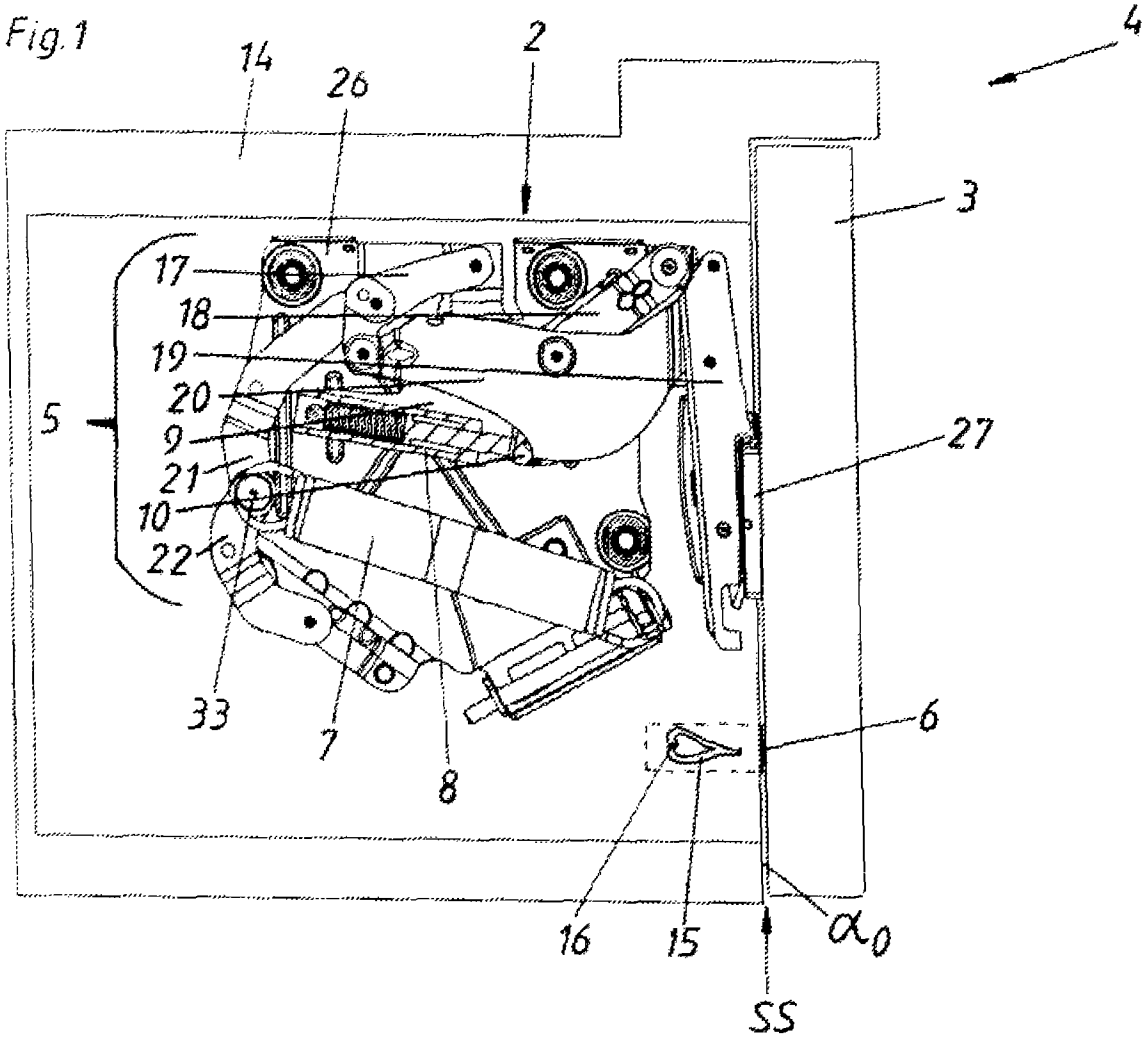
FIGS. 1 to 5 are sectional representations of the opening movement procedure of the adjusting arm arrangement type 2 in the piece of furniture.

FIG. 1 shows a piece of furniture 4 with a closed furniture flap 3 and a furniture body 14. The adjusting arm arrangement type 2 is attached to a side wall of the furniture body 14 via a fixing or guide plate 26. This adjusting arm arrangement type 2 has a lever arrangement 5 connected to the fixing plate 26 via numerous joints. This lever arrangement 5 consists substantially of eight levers 9, 10, 17, 18, 19, 20, 21 and 22 connected to one another mechanically or kinematically. Through the lever arrangement 5, locking force is exerted by the main spring 7 (spring assembly) via the entire lever arrangement 5 and the flap bracket 27. The main spring 7 on the one hand is connected to the fixing plate 26—and thus fixedly to furniture body 14—and on the other hand is connected to a lever or a joint 33 of the lever arrangement 5. In this FIG. 1, the furniture flap 3 is shown in the closed position SS, i.e. the opening angle $\alpha_0$ is 0°. With the previous closing, not shown here, the ejection device 6, which is arranged in or against the furniture body 14, is shown in the closed position SS by the flap 3. This can function, for example, in accordance with the ballpoint pen principle. In this FIG. 1, it is shown schematically that the pusher 6*a*, not shown here, of the ejection device 6, is guided via a cardioid pin 16 in the cardioid cam 15. In this closed position SS, the cardioid pin 16 remains in the locked position in the cardioid cam 15. Furthermore, the ejection-support device 8, which is arranged on a lever 9 of the lever arrangement 5, is also shown.

Figure 2:
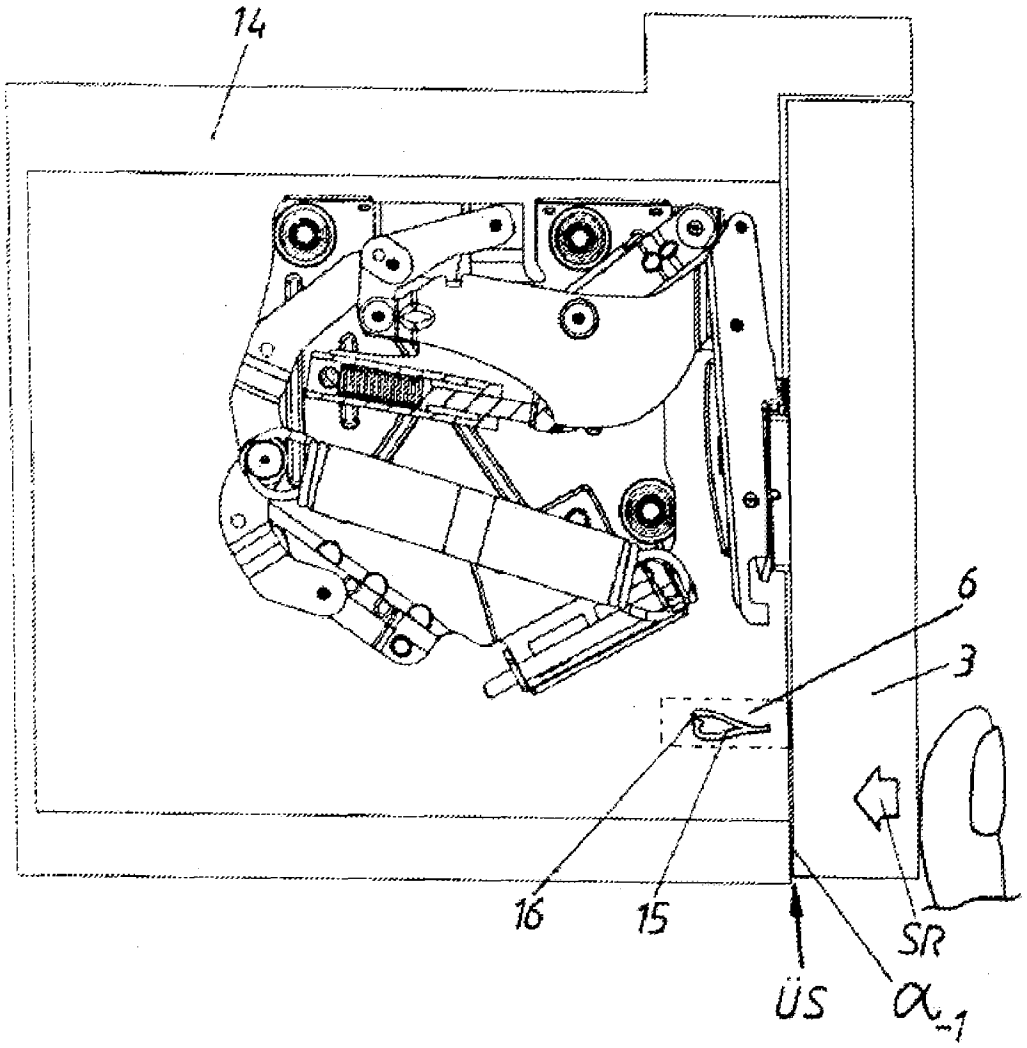

It is shown in FIG. 2 how the furniture flap 3 is brought into the overpressed closed position ÜS by a user pressing with a finger in the closing direction SR. The furniture flap 3 thus occupies an opening angle $\alpha_{-1}$ which corresponds to approximately an opening angle of −0.5°. The furniture flap 3 thus acts via the pusher 6*a* on the cardioid pin 16 which thereby leaves the locked position in the cardioid cam 15, whereby the spring-loaded pusher 6*a* of the ejection device 6 is released or is no longer held (i.e., is actuated) and can use or trigger its force A acting in the opening direction OR on the flap 3.

Figure 3:
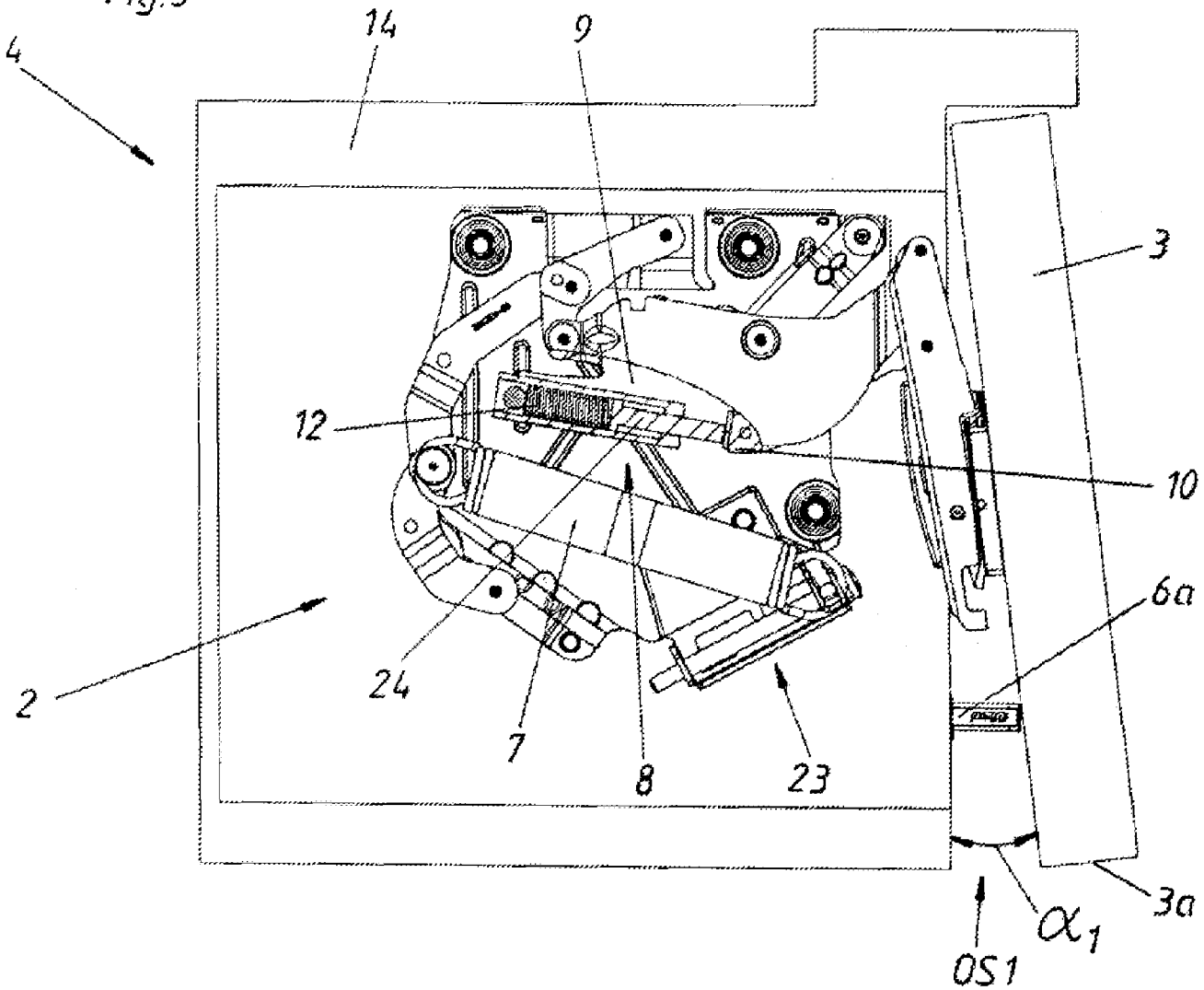

This becomes clear in FIG. 3, in which it can be seen that the pusher 6*a* brings the furniture flap 3 into the open position OS1. In this open position OS1, the opening angle $\alpha_1$ of the furniture flap 3 is 7° (this angle can differ substantially with other flap sizes). In the representation according to FIG. 3, it can also be seen how the ejection-support device 8 movement-coupled with the lever 9 via its pusher 24 loaded by the support spring 12 acts on the lever 10 and thus supports the opening movement of the ejection device 6. The two forces A and U, acting on the flap 3, of the ejection device 6 and the support spring 12 are greater than the locking force Z of the main spring 7.

Figure 4:
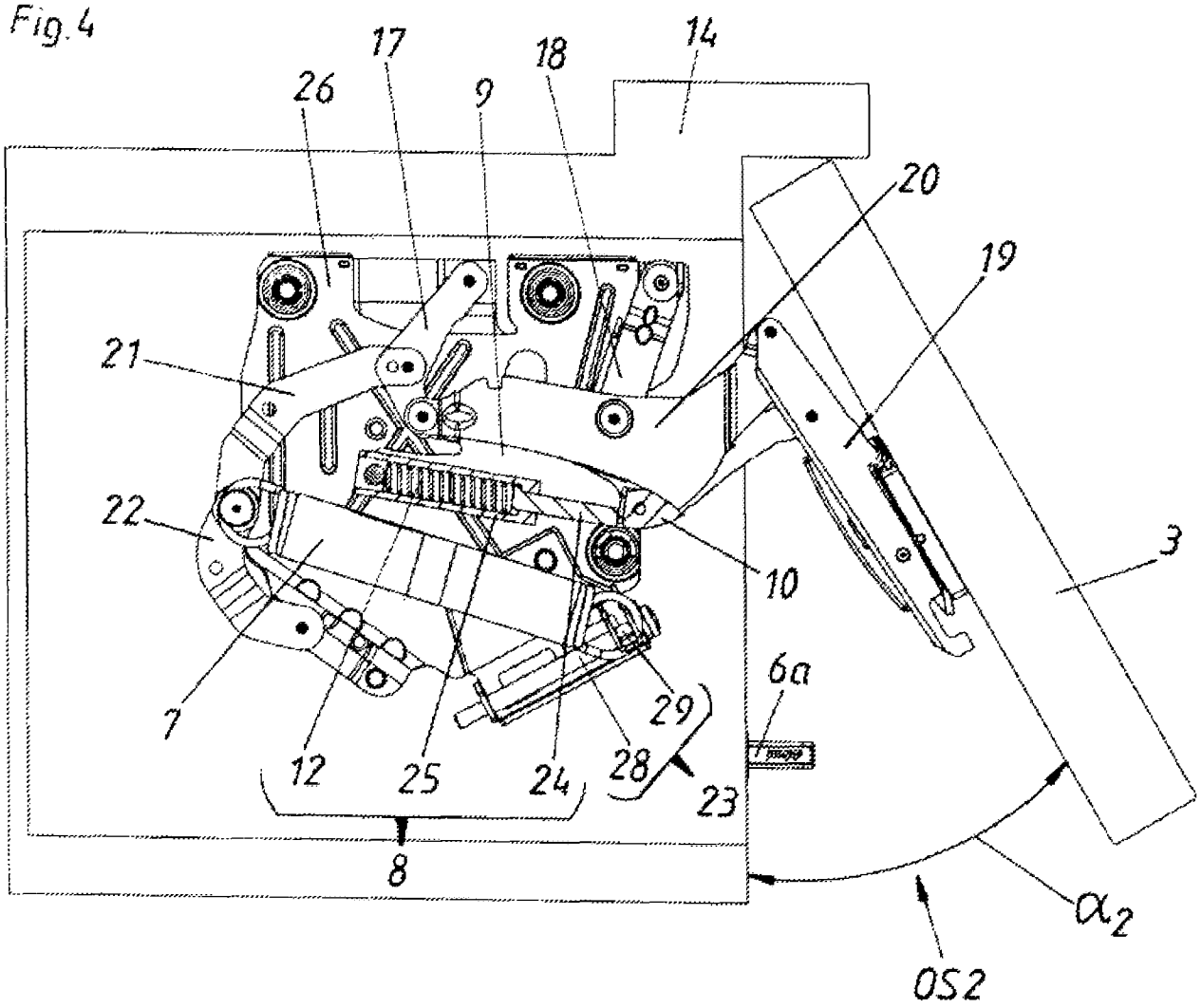
Figure 7:
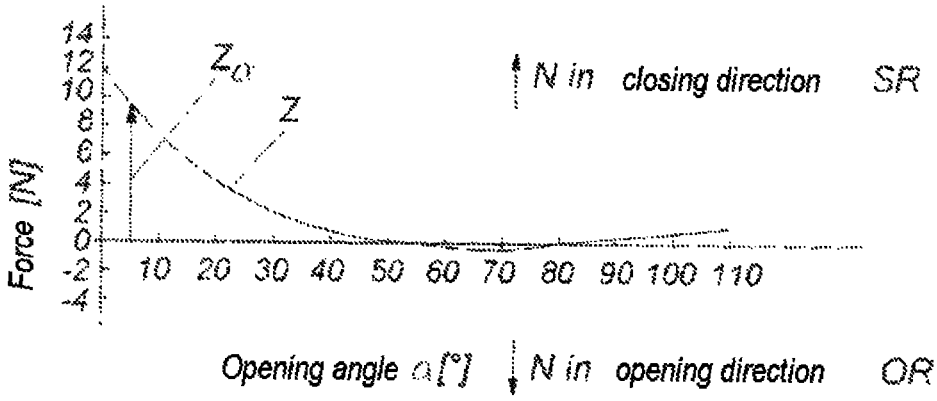
FIGS. 7 to 11 are graphs illustrating the force effects of the individual springs measured at the furniture flap.

It is shown in FIG. 4 how the ejection-support device 8 (substantially consisting of the spring 12, the housing 25 and the pusher 24) brings the furniture flap 3 from the first open position OS1 shown in FIG. 3 into the second open position OS2 shown in FIG. 4 by overcoming the already lower locking force Z between open position OS1 and open position OS2 of the main spring. In the second open position OS2, the opening angle $\alpha_2$ is 30° (this angle depends on the flap size and can thus also assume substantially higher or lower values). Through the relieving of the main spring 7 and through the lever actions of the individual levers of the lever arrangement 5, only a very small locking force Z still acts, starting approximately from this second open position OS2, on the furniture flap 3 (see FIG. 7). Through a corresponding counterbalancing, and taking account of the weight of the flap and the position of the main spring 7, the furniture flap 3 can be kept neutral from this position in any desired position. From this second open position OS2, the total force, acting in opening direction OR, of the support spring 8 was also transmitted to the lever 10 of the lever arrangement 5 and thus to the flap 3.

The setting of the spring force of the main spring 7 can be adjusted via the spring-adjustment mechanism 23. By an adjustable displacement (cf. FIGS. 4 and 5) of the holding element 29 along the adjustment screw 28, the spring force Z of the main spring 7 can be matched to the respective conditions (weight of the flap 3, kinematic translation of the lever arrangement 5, etc.).

Figure 5:
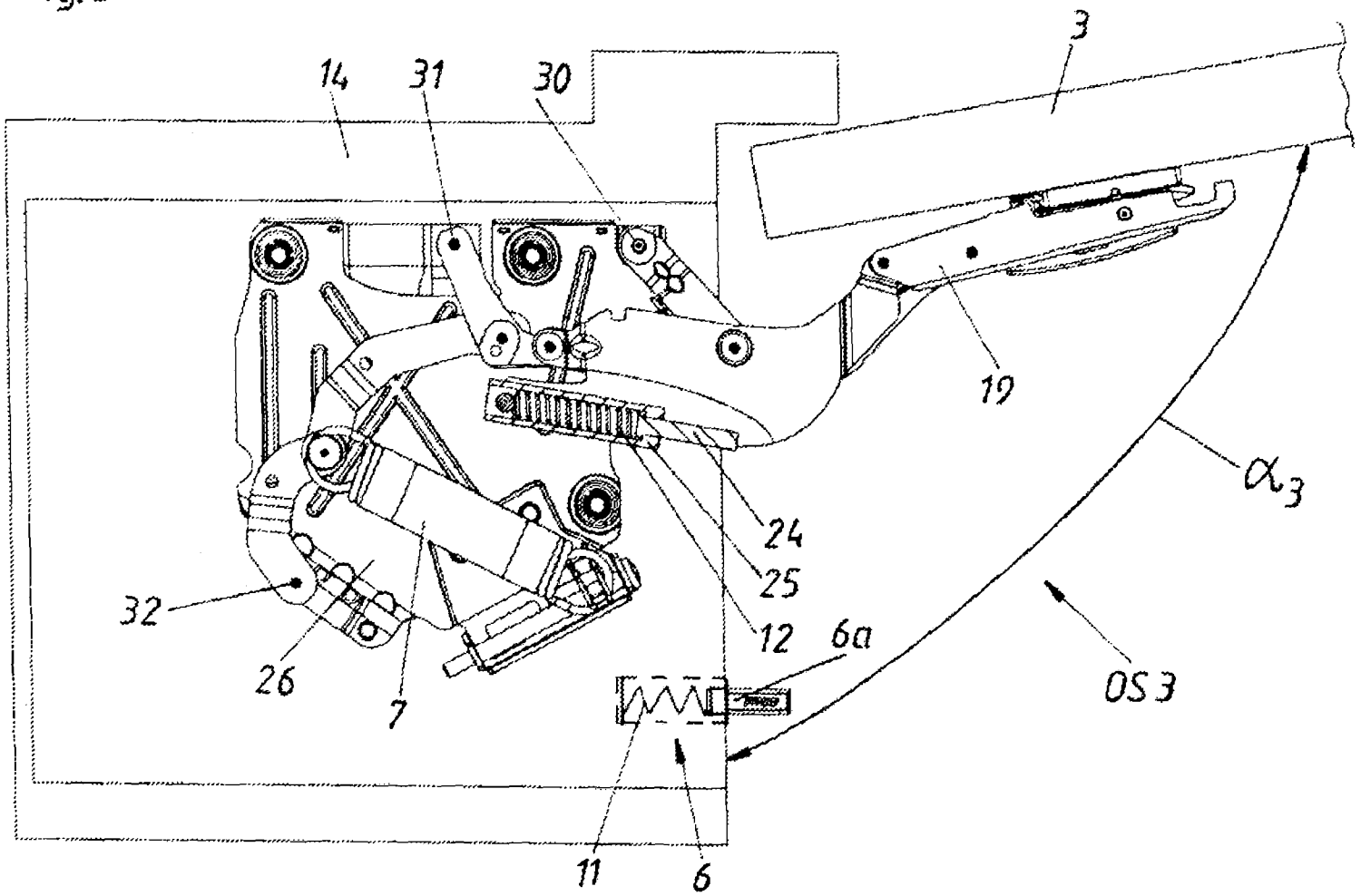

FIG. 5 shows the furniture flap 3 of the piece of furniture 4 in the maximum (third) open position OS3, wherein the opening angle $\alpha_3$ is 100°. The ejection spring 11, loading the pusher 6*a*, of the ejection device 6 is shown schematically. Furthermore, the three articulation points 30, 31 and 32 are identified via which the lever arrangement 5 is limitedly rotatably stored on the fixing plate 26.

Figure 6:
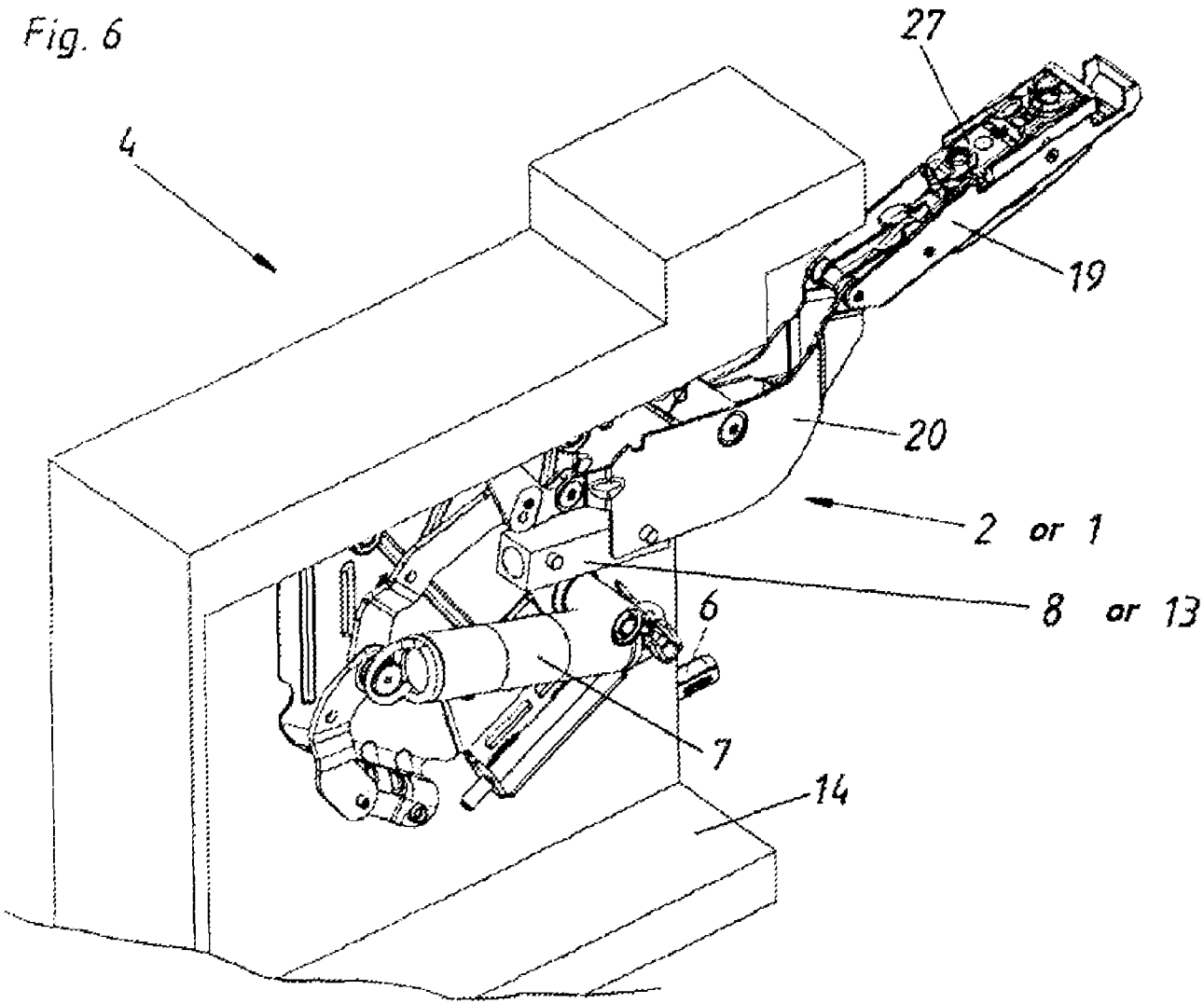
FIG. 6 is a view of the opened adjusting arm arrangement.

A view of the piece of furniture 4 with an adjusting arm arrangement 2 or 1 in open position OS3 is shown in FIG. 6. This representation thus shows both the adjusting arm arrangement type 1 and also the adjusting arm arrangement type 2. It becomes clear that the overall dimensions of the ejection-support device 8 or damping device 13 housed at the lever arrangement 5 are substantially identical. In order, generally, to convert an adjusting arm arrangement of type 1 to type 2, only the damping device 13 and ejection-support device 8 need be replaced. One or more ejection devices 6 can be provided in the lower area of the furniture body 14. Either a central ejection device 6 arranged approximately in the central, lower area of the furniture body, or two ejection devices 6, each at the side, lower area of the furniture body 14 is preferred. The flap 3 is not shown in FIG. 6, as a result of which the view of the flap bracket 27 which can be connected to the flap 3 is clear.

Diagrams of the force curves measured on the underside of the furniture flap 3*a* are shown in FIGS. 7 to 11 in relation to the forces of the main spring 7, support spring 12 and ejection device 6. In these, the vertical coordinates divide the force acting on the front underside 3*a* into Newtons, wherein positive Newton values show the force Z acting in closing direction SR and negative Newton values show the forces A and U acting in opening direction OR. Starting from the vertical position of the closed flap 3, the horizontal axis shows the opening angle $\alpha$ in angular degrees. The locking force of the main spring 7 is alone shown by the locking force curve Z represented in FIG. 7. It can be seen from this that from an opening angle $\alpha$ of approximately 40° the locking force is pretty neutral. The furniture flap 3 can thereby be kept counterbalanced in this opening angle range. The specific locking force of the main spring 7 at an opening angle $\alpha_1$ is shown as approximately 9 Newton by the arrow $Z_\alpha$. Reference is also to be made on this point to FIG. 10 which, on the one hand, shows the kinematically achievable actual locking force $Z_{IST}$ and on the other hand represents the theoretical set locking force $Z_{SOLL}$. The difference between these two values is substantiated by, inter alia, the inertia, the friction, the lever transmission etc.

Figure 8:
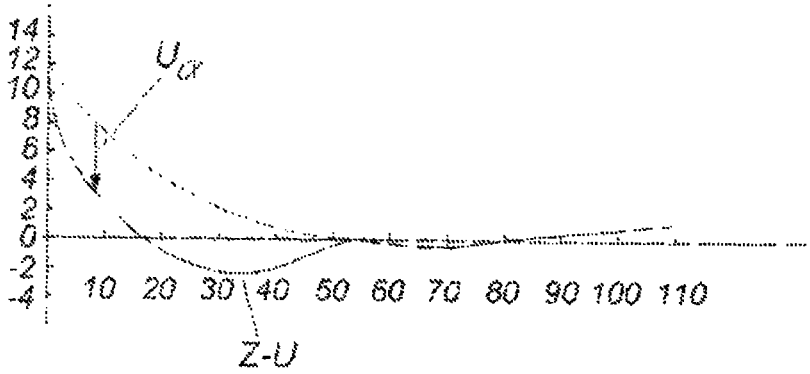
Figure 10:
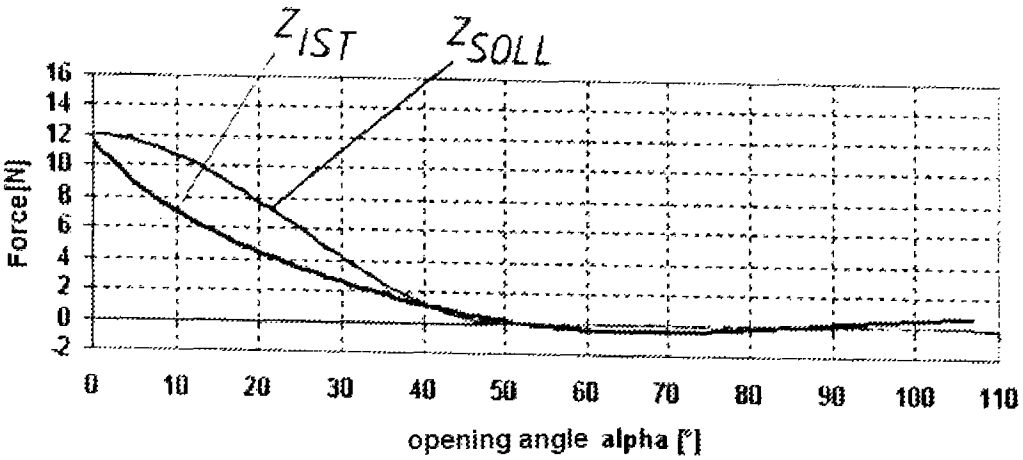
Figure 11:
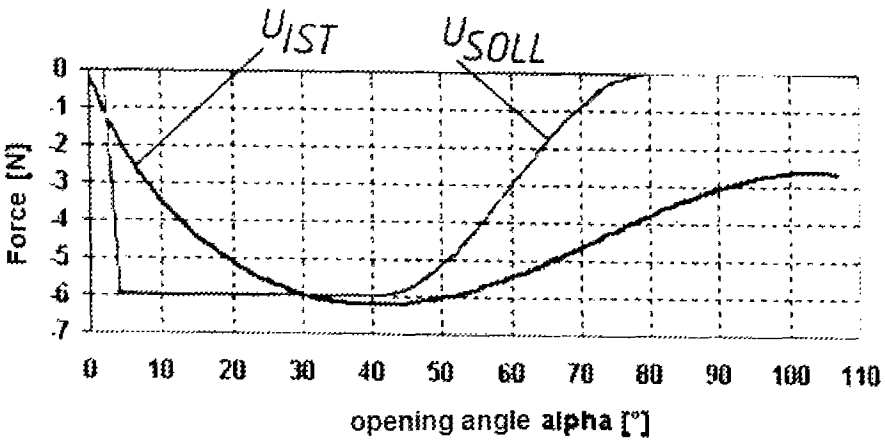

In FIG. 11, in the same way as in FIG. 10, the force $U_{IST}$ and $U_{SOLL}$ of the support spring 8 are shown. This force U has only negative Newton values, as it acts in the opening direction OR. The set opening force $U_{IST}$ acts against the locking force Z when attached to the lever arrangement 5. This can be seen particularly in FIG. 8, in which it is shown that the force $U_\alpha$ of the support spring 8 compensates or reduces the locking force Z, shown as a dotted line, of the main spring 7. Thus, the course of the curve in FIG. 8 shows the force Z-U measured at the underside of the flap 3 if only the support spring 8 and the main spring 7 are present in the adjusting arm arrangement 2. This means that, according to this FIG. 8, the force U of the support spring 8 is not sufficient to open the flap 3.

Figure 9:
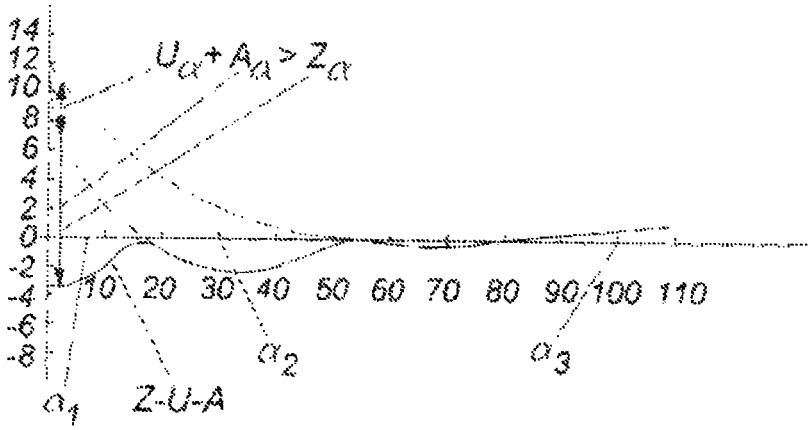

According to FIG. 9, however, this force U is sufficient together with the ejection force A to overcome the locking force Z. This means, in other words, that with an opening angle of $\alpha_0$ (or with an overpressed position ÜS and opening angle $\alpha_{-1}$) the specific measured force values $U_\alpha+A_\alpha$ are greater than the locking force $Z_\alpha$. Preferably, the added forces A and U should be greater than Z, at least up to an angle $\alpha$ of 10°. An easy-running opening of the furniture flap 3 is guaranteed by the corresponding matching of the individual spring forces. This can be seen in particular from the force curve Z-U-A arranged in the low negative Newton range. A gentle opening of the flap is thereby made possible, and abrupt movements are prevented.

Figure 12:
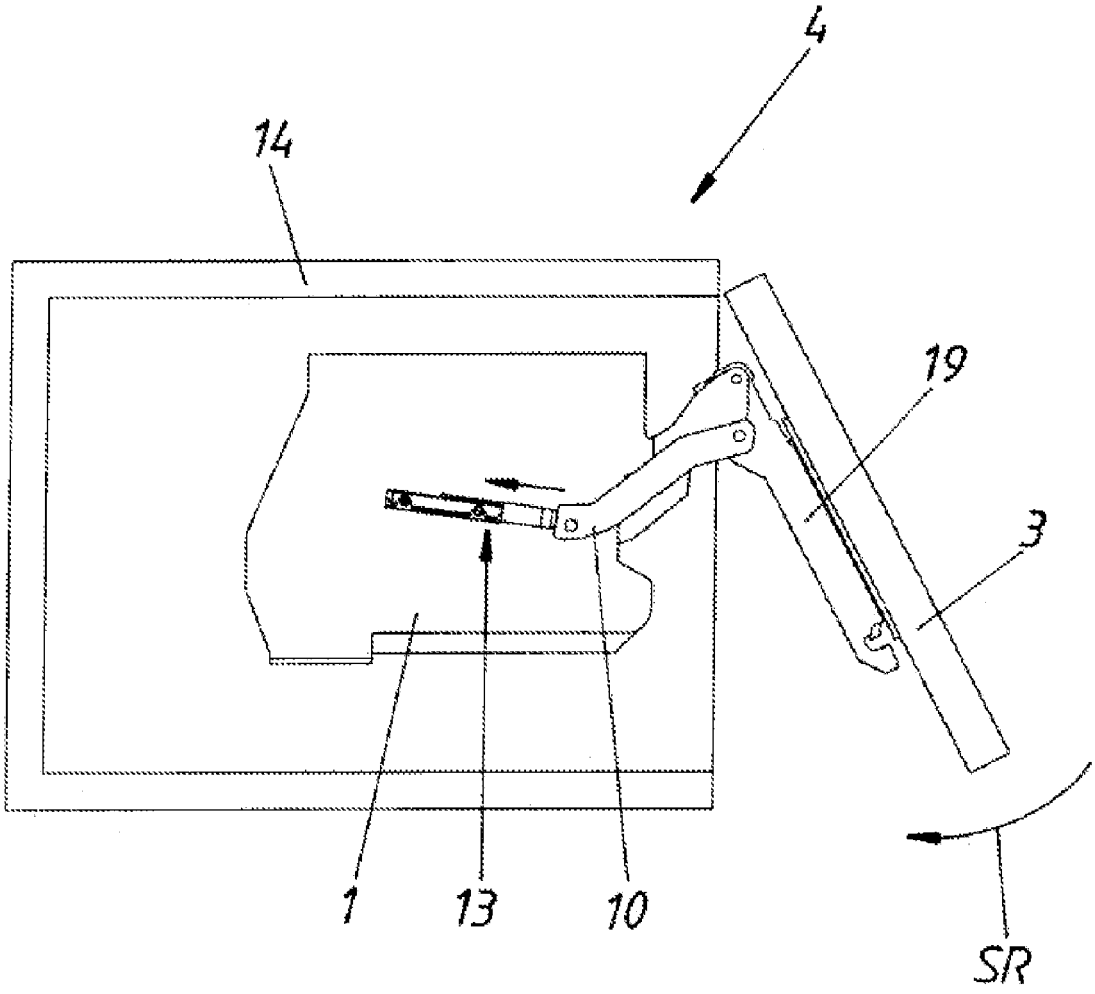
FIGS. 12 and 13 are diagrams illustrating the closing movement of the adjusting arm arrangement type 1
Figure 13:
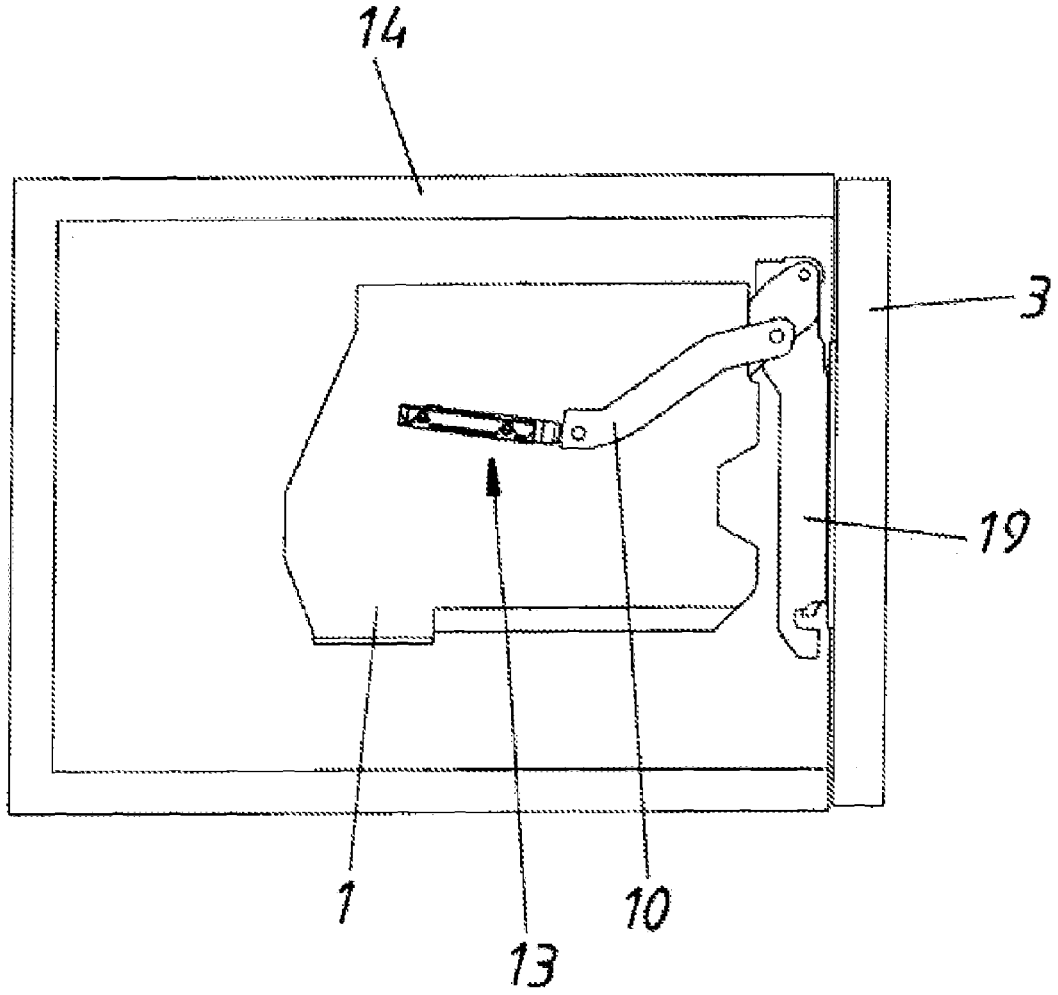

FIG. 12 shows a piece of furniture 4 with an adjusting arm arrangement type 1, wherein the damping device 13 damps furniture flap 3 moving in the closing direction SR. The pusher of the damping device 13 is loaded via the levers 19 and 10, whereby the closing movement is delayed. The adjusting arm arrangement type 1 is shown in the closed position in FIG. 13.

Figure 14:
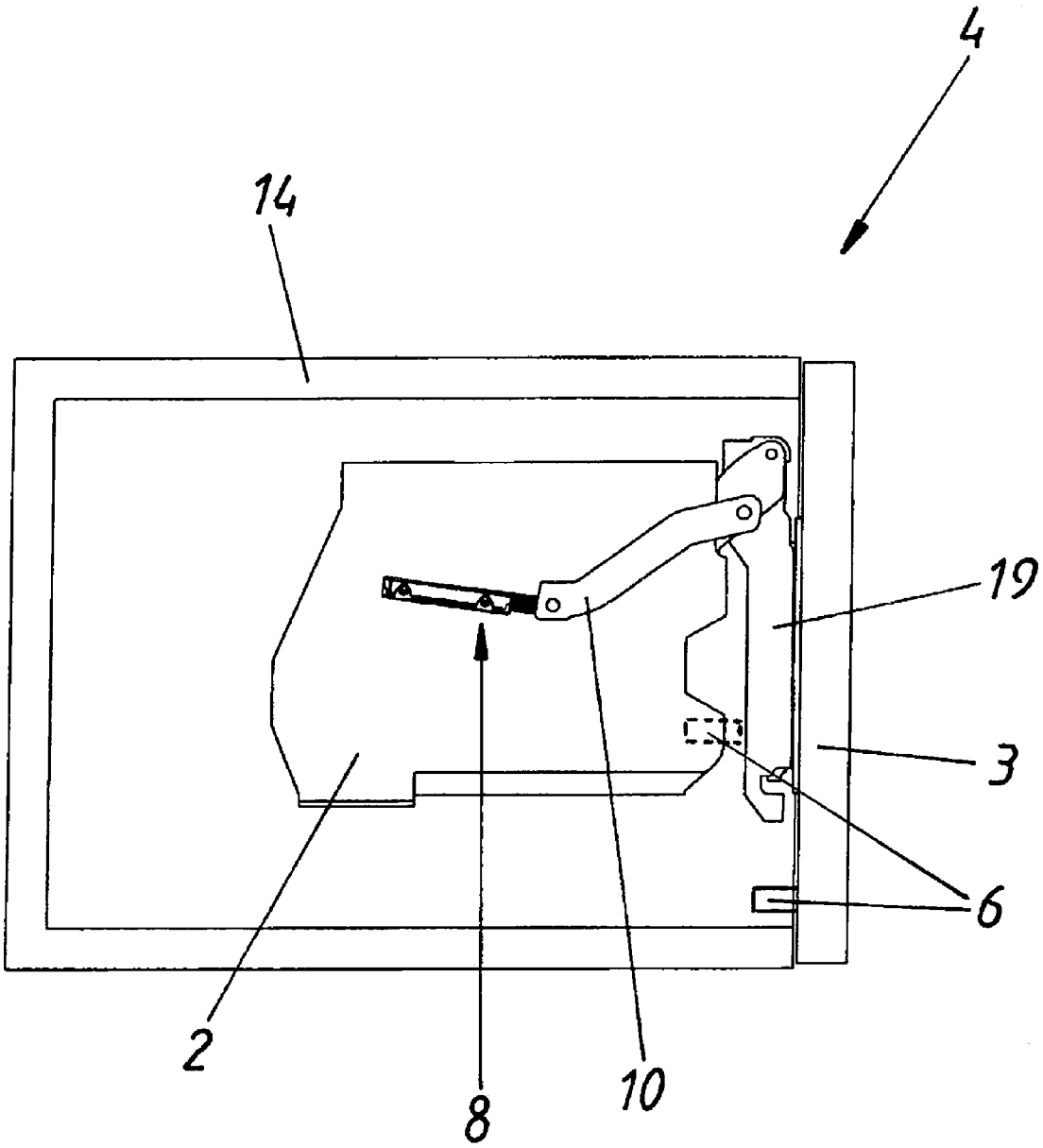
FIGS. 14 and 15 are diagrams illustrating the opening movement of the adjusting arm arrangement type 2.
Figure 15:
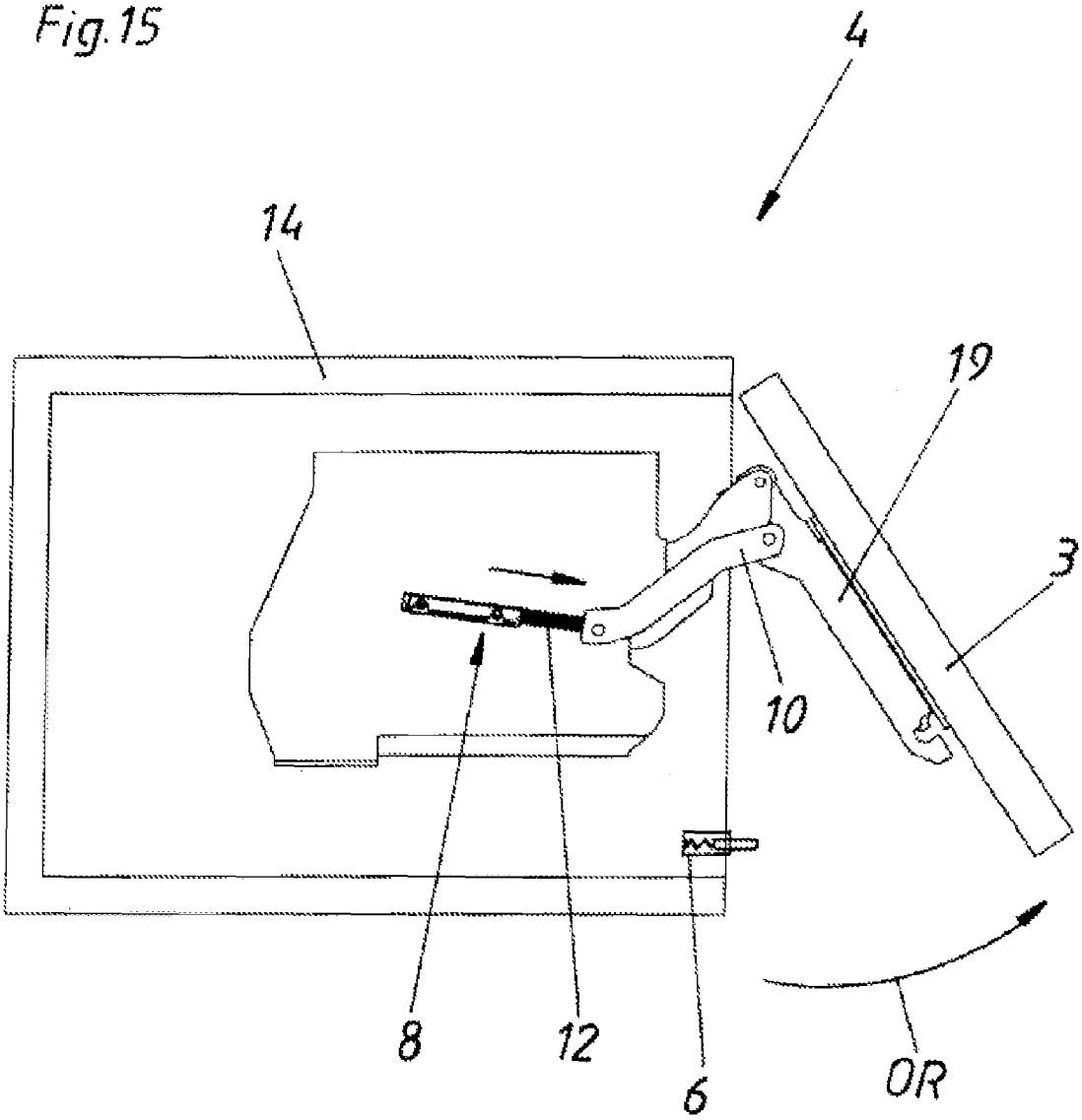

In FIG. 14, on the other hand, the adjusting arm arrangement type 2 is shown in the closed position, wherein the tensioned spring 12 of the ejection-support device 8 is not sufficient on its own to overcome the locking force of the main spring 7 (not shown here) and thus make possible a movement in the opening direction OR of flap 3. As shown in FIG. 15, the ejection device 6 is provided on the furniture body (although the ejection device 6 could also be attached to a lever or even to the fixing plate 26 as shown by the broken lines in FIG. 14) which ejects the furniture flap 3 in opening direction OR. This is achieved by supporting the spring 12, relaxing after unlocking, of the ejection-support device 8.

Figure 16:
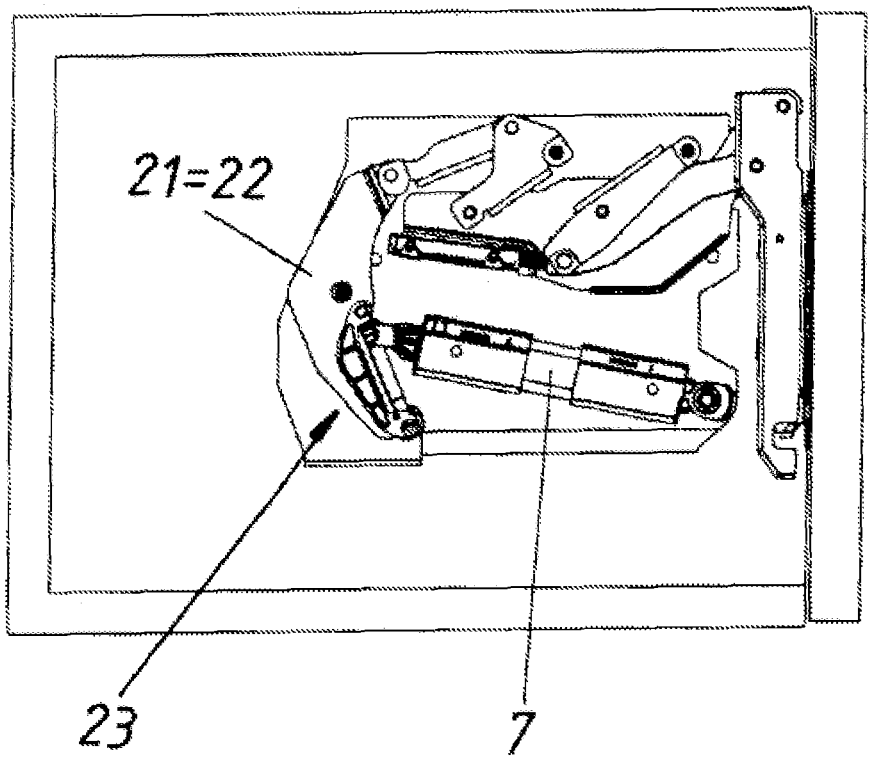
FIGS. 16 and 17 are diagrams illustrating an alternative lever arrangement structure.
Figure 17:
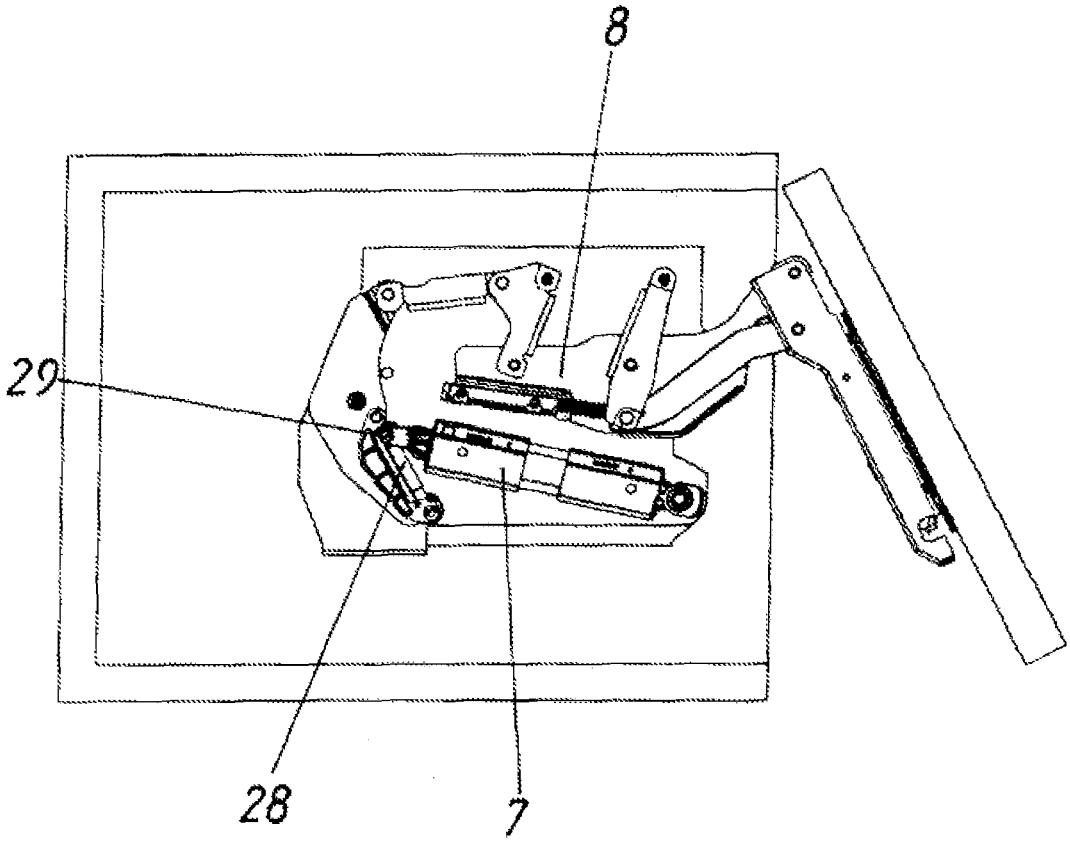

FIGS. 16 and 17 show the levers 21 and 22, separate in the other Figures, in one piece, wherein the spring-adjustment mechanism 23 for the main spring 7 is attached to this one-piece lever.

Thus, a piece of furniture with an adjusting arm arrangement, an adjusting arm arrangement for opening heavy flaps, and a set of adjusting arm arrangements is shown by the invention present here, wherein the above-described opening of heavy flaps for users of pieces of furniture with raisable flaps is made easier and is designed for convenience.

The invention claimed is:

1. An adjusting arm arrangement kit comprising:

a lever arrangement to be connected to a flap, said lever arrangement including a first lever and a second lever;

a main spring for acting on said lever arrangement so as to thereby act on the flap via said lever arrangement in a closing direction of the flap;

a damping device configured to apply a damping force to the flap in a closing direction of the flap in a first configuration of said adjusting arm arrangement kit; and an ejection support device integrated into said lever arrangement and configured to act on said lever arrangement so as to thereby act on the flap in an opening direction of the flap in a second configuration of said adjusting arm arrangement kit, said ejection support device including:

a support spring mounted on said first lever of said lever arrangement and acting on said second lever of said lever arrangement; and a pusher loaded via said support spring and configured to act on said lever arrangement so as to thereby act on the flap in the opening direction of the flap, said pusher configured to lie against said second lever of said lever arrangement, only a spring force of said support spring acting on said pusher;

wherein said adjusting arm arrangement kit is convertible from said first configuration of said adjusting arm arrangement kit to said second configuration of said adjusting arm arrangement kit by replacing said damping device with said ejection support device;

wherein said main spring and said support spring are configured so that, in a range of relative opening angles between a furniture body and the flap of 0° to 10°, a spring force of said support spring acting on said furniture flap in the opening direction of said furniture flap is less than the spring force of said main spring acting on said furniture flap in the closing direction of said furniture flap; and wherein said main spring and said support spring are configured so that, in a range of relative opening angles between said furniture body and said furniture flap of 20° to 50°, the spring force of said support spring acting on said furniture flap in the opening direction of said furniture flap is greater than the spring force of said main spring acting on said furniture flap in the closing direction of said furniture flap.

2. The adjusting arm arrangement kit of claim 1, wherein said ejection support device further includes a housing accommodating said support spring, said pusher and said support spring being guided by said housing.

3. The adjusting arm arrangement kit of claim 1, wherein said damping device of said first type and said ejection-support device of the second type have substantially identical overall dimensions.

4. The adjusting arm arrangement kit of claim 1, wherein said support spring is a coil spring.

* * * * *